US008808958B2

(12) United States Patent
Jang et al.

(10) Patent No.: US 8,808,958 B2
(45) Date of Patent: Aug. 19, 2014

(54) PROCESS FOR PREPARING POLYMERIZED TONER

(75) Inventors: Wook Jang, Daejeon (KR); Chang-Soon Lee, Daejeon (KR); Dong-Jin Park, Daejeon (KR); Jung-Woo Kim, Daejeon (KR)

(73) Assignee: LG Chem, Ltd., Seoul (KR)

( * ) Notice: Subject to any disclaimer, the term of this patent is extended or adjusted under 35 U.S.C. 154(b) by 87 days.

(21) Appl. No.: 13/243,981

(22) Filed: Sep. 23, 2011

(65) Prior Publication Data

US 2012/0107736 A1 May 3, 2012

(30) Foreign Application Priority Data

Oct. 27, 2010 (KR) ..... 10-2010-0105301
Sep. 23, 2011 (KR) ..... 10-2011-0096419

(51) Int. Cl.
*G03G 9/08* (2006.01)

(52) U.S. Cl.
USPC ..... 430/137.17; 430/137.15

(58) Field of Classification Search
USPC ..... 430/137.17, 137.15
See application file for complete search history.

(56) References Cited

U.S. PATENT DOCUMENTS 4,939,060 A * 7/1990 Tomiyama et al. ..... 430/106.1
5,529,873 A 6/1996 Chiba et al.
5,571,653 A 11/1996 Kasuya et al.
2008/0286675 A1 11/2008 Tani et al.
2009/0233203 A1* 9/2009 Yuasa et al. ..... 430/108.4
2010/0190103 A1* 7/2010 Jang et al. ..... 430/137.15
2010/0316944 A1 12/2010 Nakajima et al.

FOREIGN PATENT DOCUMENTS

CN 1662584 A 8/2005
CN 101097411 A 1/2008
CN 101681137 A 3/2010
JP 05-045923 * 2/1993 ..... G03G 9/08
JP 05-095289 A 4/1993
JP 2004-341397 A 12/2004
KR 10-0163074 A 11/1994
KR 10-2006-0111180 A 10/2006
KR 10-2009-0040532 A 4/2009
KR 10-2009-0115889 A 11/2009

OTHER PUBLICATIONS

Translation of JP 05-045923 published Feb. 1993.*

* cited by examiner

*Primary Examiner* — Peter Vajda
(74) *Attorney, Agent, or Firm* — Rothwell, Figg, Ernst & Manbeck, P.C.

(57) ABSTRACT

The present invention relates to a process for preparing a polymerized toner, and in particular to a process for preparing a polymerized toner and a polymerized toner prepared therefrom, wherein a certain block copolymer and copper phthalocyanine are used within a predetermined range of the amounts for a carbon black dispersant during a suspension polymerization, thereby making it possible to realize a narrow particle sizes distribution, high transcription efficiency, and an enhanced image concentration.

15 Claims, No Drawings

PROCESS FOR PREPARING POLYMERIZED TONER

CROSS-REFERENCE TO RELATED APPLICATION

This application claims priority to and the benefit of Korean Patent Application Nos. 2010-0105301 and 2011-0096419 filed in the Korea Intellectual Property Office on Oct. 27, 2010 and Sep. 23, 2011, respectively, the entire contents of which are incorporated herein by reference.

BACKGROUND OF THE INVENTION (a) Field of the Invention

The present invention relates to a process for preparing polymerized toners, and more specifically to a process for preparing polymerized toners having a higher image concentrations and excellent transcription efficiency and thus being able to exhibit superior performance in the field of developing electronic pictures.

(b) Description of the Related Art

Toners as used for developing electronic pictures, and for electrostatic printers and copying machines refer to a paint capable of being transcribed and fused into an object to form a desired pattern thereon. With computers being more commonly used in word processing in recent years, there have been rapidly growing demands for imaging apparatuses such as printers, resulting in an increase in the use of toners as well.

Typically, toners are prepared by using a pulverization method or a polymerization method. Most widely known is a preparation process by using the pulverization method, wherein resins and pigments are put into a melt-mixing process together, melt-mixed or extruded, and then pulverized and sorted out to give toner particles. However, this process has drawbacks in that the toner particles thus obtained have a broad particle size distribution and very irregular shapes including sharpened edges so that they are inferior in chargeability or flowability.

For the purpose of addressing the above-mentioned problems, a process for preparing spherical toner particles by using a polymerization method was proposed. For such a preparation process of toners by using polymerization, an emulsion polymerization (coagulation process) and a suspension polymerization were known in the art. The process for preparing toners by using the suspension polymerization was preferred since the emulsion polymerization had difficulties in controlling a particle size distribution and reproducing the quality of the obtained toners.

For the preparation of toners by using the suspension polymerization, binder resin monomers and various additives including a pigment, a wax, a charge control agent, or an initiator were uniformly dispersed to provide a monomer mixture, which is then dispersed in an aqueous dispersion in the form of fine droplets before being subjected to a polymerization process. In such a polymerization process, it is very difficult to prepare toner particles with a narrow particle size distribution. In particular, when carbon black is used in order for the polymerized toner prepared by the suspension polymerization to express a black color, the conductivity of carbon black contained in the toner may cause a decrease in the chargeability of the toner, leading to lowered transcription efficiency.

Accordingly, there has been a need for researches to develop a process capable of effectively preparing toners that not only show highly uniform chargeability even with carbon black contained therein so as to enable a realization of high transcription efficiency but also have a narrow particle size distribution, and in particular capable of preparing a polymerized toner enabling a realization of a higher image concentration and excellent transcription efficiency.

SUMMARY OF THE INVENTION

The present invention is to provide a process for effectively preparing a polymerized toner that can realize a higher image concentration and excellent transcription efficiency.

The present invention provides a process for preparing a polymerized toner, which comprises the steps of forming an aqueous dispersion comprising a dispersant; forming a monomer mixture comprising a binder resin monomer, carbon black, a styrene block copolymer, copper phthalocyanine, a charge control agent, and a wax; and adding the monomer mixture to the aqueous dispersion and subjecting the same to a suspension polymerization to form toner particles, wherein 1 to 20 parts by weight of carbon black, 0.05 to 5 parts by weight of the styrene block copolymer, and 0.1 to 3 parts by weight of copper phthalocyanine are included with respect to 100 parts by weight of the monomer mixture.

The weight average molecular weight of the styrene block copolymer can be 2,000 to 200,000.

The wax and the charge control agent can be included in an amount of 0.1 to 30 parts by weight and in an amount of 0.1 to 5 parts by weight, respectively, based on 100 parts by weight of the monomer mixture.

The dispersant can comprise at least one selected from the group consisting of an inorganic dispersant, a water-soluble organic dispersant, and an anionic surfactant.

The binder resin monomers can be at least one selected from the group consisting of an aromatic vinyl monomer, an acrylate monomer, a methacrylate monomer, and a diene monomer.

The wax can be at least one selected from the group consisting of paraffin wax, microcrystalline wax, ceresin wax, carnauba wax, polyester wax, and polypropylene wax.

The charge control agent can comprise at least one selected from the group consisting of a cationic charge control agent, an anionic charge control agent, and a mixture thereof.

The monomer mixture can further include at least one additive selected from the group consisting of an initiator, a crosslinker, a lubricant, a molecular weight controlling agent, and a coupling agent.

The average diameter of carbon black particles can be between 20 nm and 50 nm.

The formation of the toner particle can comprise the steps of adding the monomer mixture to the aqueous dispersion; homogenizing the monomer mixture in the aqueous dispersion in the form of droplets by applying shearing force to the aqueous dispersion and the monomer mixture; and subjecting the homogenized monomer mixture to a suspension polymerization.

The suspension polymerization can comprise the steps of conducting a reaction at a temperature of 50-70° C. for 8-12 hours; and conducting a reaction at an elevated temperature of 80-100° C. for 0.5-4 hours.

The process can further comprise the steps of removing the dispersant; and drying the toner particles formed from the suspension polymerization.

In addition, the process can further comprise a step of coating an external additive on the outside of the toner particles.

The present invention also provides a polymerized toner prepared from the above process.

DETAILED DESCRIPTION OF THE EMBODIMENT

Hereinafter, the preparation process of polymerized toners according to specific embodiments of the present invention will be explained.

The present inventors have found the following and completed the present invention: in preparation of toners by the suspension polymerization, using copper phthalocyanine and a certain block copolymer within a predetermined range of the amounts as a dispersant for carbon black makes it possible to ensure the dispersion stability and the stability for the suspension polymerization and to enhance the stability of carbon black in the obtained toner particles, thereby allowing not only a higher image concentration for the printing products but also realization of high transcription efficiency. Such polymerized toners can be effectively applied in the field of printing pictures that are required to have a high image concentration.

In particular, the present invention can employ any typical suspension polymerization for polymerized toners except for using copper phthalocyanine and a certain styrene block copolymer together as a dispersant for carbon black, wherein carbon black, the styrene block copolymer, and copper phthalocyanine can be used in an amount of 1 to 20 parts by weight, in an amount of 0.05 to 5 parts by weight, and in an amount of 0.1 to 3 parts by weight, respectively, base on 100 parts by weight of the monomer mixture.

In a typical suspension polymerization method, a pigment, a charge control agent, a wax, and the like are dissolved or dispersed in the binder resin monomers to produce as a monomer mixture, which is then dispersed in an aqueous dispersing medium with a stirrer to form fine droplets of the monomer mixture and then subjected to a suspension polymerization at an elevated temperature, allowing one to obtain toners with a desired particle size.

The present invention is characterized in that when carbon black is used as a pigment in such a suspension polymerization method, copper phthalocyanine and a certain block copolymer are used together as a dispersant for carbon black with being mixed at optimum contents thereof, thereby securing an excellent level of dispersion stability of carbon black in toner particles, effectively controlling the diameter of the toner particles, and preparing polymerized toners with a narrow particle size distribution.

Thus, the present invention provides a process for preparing polymerized toners, which comprises the steps of forming an aqueous dispersion comprising a dispersant; forming a monomer mixture comprising a binder resin monomer, carbon black, a styrene block copolymer, copper phthalocyanine, a charge control agent, and a wax; and adding the monomer mixture to the aqueous dispersion and subjecting the same to a suspension polymerization to form toner particles, wherein 1 to 20 parts by weight of carbon black, 0.05 to 5 parts by weight of the styrene block copolymer, and 0.1 to 3 parts by weight of copper phthalocyanine are included with respect to 100 parts by weight of the monomer mixture.

According to the preparation process of the present invention, a monomer mixture comprising a binder resin monomer, carbon black, a styrene block copolymer, copper phthalocyanine, a charge control agent, and a wax is added to an aqueous dispersion comprising a dispersant to be dispersed in the form of fine droplets, and then the resulting dispersion is subjected to a suspension polymerization. Through such polymerization process, the monomer mixture undergoes a polymerization in the form of fine droplets to produce toner particles, which can be prepared as polymerized toners of the present invention.

In particular, the results from the experiments conducted by the present inventors show that using carbon black in an amount of 1 to 20 parts by weight with respect to 100 parts by weight of the monomer mixture and at the same time using copper phthalocyanine and a styrene block copolymer as a dispersant for carbon black in an optimum amount of 0.05 to 5 parts by weight and in an optimum amount of 0.1 to 3 parts by weight, respectively, with respect to 100 parts by weight of the monomer mixture can enhance the stability of carbon black in the toner particles as prepared, thereby making it possible to realize a higher image concentration and excellent transcription efficiency.

Now, each step of the preparation process for toners will be explained as follows.

In the above preparation process, first formed is an aqueous dispersion comprising a dispersant, and also formed is a monomer mixture comprising a binder resin monomer, carbon black, a styrene block copolymer, copper phthalocyanine, a charge control agent, and a wax. Then, the monomer mixture is added to the aqueous dispersion and dispersed in the form of droplets. For effectively dispersing the monomer mixture, the aqueous dispersion can be obtained by dissolving the dispersant in water. According to the present invention, employing such dispersant allows the monomer mixture to be stably maintained at the dispersion state in the aqueous medium.

The dispersant can comprise at least one selected from the group consisting of an inorganic dispersant, a water soluble organic dispersant, an anionic surfactant, and a mixture thereof. The dispersant can be used in an amount of 1 to 5 parts by weight, preferably 2 to 4 parts by weight, and more preferably 2.5 to 3.5 parts by weight with respect to 100 parts by weight of the monomer mixture.

As specific examples for the inorganic dispersant, mentions may be made of calcium phosphate, calcium hydrogen phosphate, calcium dihydrogen phosphate, hydroxyl apatite, magnesium phosphate, aluminum phosphate, zinc phosphate, calcium carbonate, magnesium carbonate, calcium hydroxide, magnesium hydroxide, aluminum hydroxide, calcium methasilicate, calcium sulfate, barium sulfate, bentonite, silica, alumina, or a mixture thereof.

As specific examples for the water soluble organic dispersant, mentions may be made of polyvinyl alcohol, gelatin, methyl cellulose, methyl hydroxy propyl cellulose, ethyl cellulose, carboxylmethyl cellulose and its sodium salts, polyacrylic acid and its salts, starch, or a mixture thereof.

As specific examples of the anionic surfactant, mentions may be made of a fatty acid salt, an alkyl sulfate ester salt, an alkylaryl sulfate ester salt, a dialkyl sulfosuccinate salt, an alkyl phosphate salt, or a mixture thereof.

As a more preferred examples for the dispersant, mentions may be made of calcium phosphate, which can be obtained as a crystal form in an aqueous solution by mixing an aqueous solution of sodium phosphate and an aqueous solution of calcium chloride. In this case, the aqueous dispersion may comprise the calcium phosphate crystals as uniformly dispersed therein.

As described above, the preparation process for polymerized toners of the present invention comprises the steps of forming a monomer mixture comprising a binder resin monomer, carbon black, a styrene block copolymer, copper phthalocyanine, a charge control agent, and a wax, and then adding the monomer mixture to the aqueous dispersion comprising the dispersant and dispersing the same in the form of droplets.

In the present invention, the binder resin monomer can be any one used for a polymerized toner with no particular limitation. As examples of the monomer, mentions may be made of a styrene monomer, an acrylate monomer, a methacrylate monomer, and a diene monomer. It is possible to use a mixture of at least one of the foregoing monomers. In addition, at least one of acidic or basic olefin monomers may be optionally mixed with the foregoing monomers.

The styrene monomer can be styrene, monochlorostyrene, methylstyrene, dimethylstyrene, and the like. The acrylate monomer can be methylacrylate, ethylacrylate, n-butylacrylate, isobutylacrylate, dodecyl acrylate, 2-ethylhexylacrylate and the like. The methacrylate monomer can be methyl methacrylate, ethyl methacrylate, n-butyl methacrylate, isobutyl methacrylate, dodecyl methacrylate, 2-ethyl hexyl methacrylate, and the like. The diene monomer can be butadiene, isoprene, and the like. For the acidic olefin monomer, one can use an α,β-ethylene unsaturated compound with a carboxylic group and the like, and for the basic olefin monomer, one can use methacrylic acid esters of an aliphatic alcohol having an amine group or a quaternary ammonium group, methacrylamides, vinyl amines, dially amines, or an ammonium salt thereof.

In addition, as the binder resin monomer, it is possible to use a mixture wherein (a) a styrene monomer and (b) at least one monomer selected from the group consisting of an acrylate monomer, a methacrylate monomer, and a diene monomer are mixed at a weight ratio of 10:1 to 1:1, preferably 9:1 to 1.5:1, and more preferably 5:1 to 2.5:1. When polymerization is carried out with at least two binder resin monomers as mixed at a predetermined ratio as above, one can control the glass transition temperature ($T_g$) of the binder resin within a suitable range, thereby achieving an excellent offset property. If the weight ratio between (a) the styrene monomer and (b) at least one selected from the group consisting of the acrylate monomer, the methacrylate monomer, and the diene monomer exceeds 10:1, a cold offset phenomenon may occur. If the weight ratio is below 1:1, a hot offset phenomenon may occur.

The binder resin monomer can be included in an amount of 50 to 95 parts by weight, preferably 60 to 93 parts by weight, more preferably 70 to 90 parts by weight with respect to 100 parts by weight of the monomer mixture. The binder resin monomer can be included in such an amount for realization of a uniform image and an improvement on the transcription efficiency.

Together with the binder resin monomer, the monomer mixture comprises carbon black, a styrene block copolymer, and copper phthalocyanine. In particular, according to the present invention, carbon black is included as a pigment, and for effectively dispersing carbon black and improving the stability thereof, the styrene block copolymer and copper phthalocyanine are used as a dispersant for carbon black.

For carbon black, one can use any one known to be usable for a black toner prepared by polymerization without particular limitations. However, what can be used in light of the dispersability in the toner particle is carbon black particles having an average diameter of 20 to 50 nm, preferably 30 to 40 nm.

Also, as described above, carbon black as used in such a manner can lead to a lowered chargeability of toners due to its own conductivity when being included in the toner particle. According to the present invention, by using the styrene block copolymer and copper phthalocyanine within a predetermined range of the amounts as a dispersant for carbon black, carbon black is made to exhibit an enhanced stability in toner particles and to show a uniform chargeability, and thereby the resulting toners can realize a higher image concentration and excellent transcription efficiency.

Using the styrene block copolymer and copper phthalocyanine together as a dispersant for carbon black can increase the compatibility of carbon black with the monomers and thereby the carbon black particles are less likely to be concentrated on the toner surfaces, and thus one can obtain better results. However, using the styrene block copolymer alone as a dispersant for carbon black may not achieve excellent transcription efficiency together with a high image concentration since an increase in the content of carbon black may bring about a decrease in transcription efficiency. In addition, using copper phthalocyanine alone as a dispersant for carbon black leads to the formation of so called "emulsion particles" with a size less than 1 μm during the suspension polymerization, disadvantageously making the image uneven and lowering the transcription efficiency. Such a concentration phenomenon of the carbon black particles on the toner surface is believed to arise from the conductivity of carbon black itself. In the beginning of the polymerization after the monomer mixture is dispersed in the aqueous dispersion, carbon black particles move toward the surface of the toner particle due to the electrostatic attraction to show themselves on the surface. In the present invention, using the styrene block copolymer and copper phthalocyanine as mixed at the optimum contents allows an improvement on the dispersability of the carbon black particles together with a decrease in their conductivity, thereby achieving enhanced transcription efficiency.

The styrene block copolymer that can be used has a weight average molecular weight of 2,000 to 200,000, preferably 5,000 to 180,000, and more preferably 7,000 to 160,000. A styrene block copolymer with a weight average molecular weight less than 2,000 would fail to serve well as a dispersant for carbon black due to its high compatibility with the binder resin, while a styrene block copolymer with a weight average molecular weight higher than 200,000 would cause highly viscous monomer mixture to make the dispersion stability and polymerization stability worse, resulting in a broader distribution of granularity.

As the styrene block copolymer, one can use at least one selected from triblock copolymers such as styrene-butadiene-styrene (SBS), styrene-isoprene-styrene (SIS), styrene-ethylene-butylene-styrene (SEBS), styrene-ethylene-propylene-styrene (SEPS), or a di- or tri-block copolymers such as styrene-butadiene (SB), styrene-isoprene (SI), styrene-ethylene-butylene (SEB), styrene-ethylene-propylene (SEP), and the like.

In particular, as the styrene block copolymer, one can use a styrene-butadiene-styrene block copolymer with a ratio between the styrene content to the butadiene content being 10:90 to 90:10, preferably 15:85 to 85:15, more preferably 20:80 to 80:20. If the styrene content exceeds 90%, the shortened block of butadiene results in a higher compatibility with the binder resin so that the block copolymer may fail to serve well as a dispersant for carbon black. If the styrene content is less than 10%, the block copolymer has a good compatibility with carbon black, but its compatibility with the monomers is too poor for the block copolymer to play a sufficient role of a dispersant for carbon black.

In addition, copper phthalocyanine that can be used as a dispersant for carbon black contains a free Cu in an amount of 10 to 2,000 ppm, and it can also have a derivative form wherein the phthalocyanine ring comprises various substituents bonded thereto.

Carbon black is included in an amount of 1 to 20 parts by weight, preferably 2 to 15 parts by weight, and more preferably 3 to 10 parts by weight with respect to 100 parts by weight of the monomer mixture. In light of the image concentration, carbon black is included in an amount of at least one part by weight with respect to 100 parts by weight of the monomer mixture, and in light of transcription efficiency, it is included in an amount of no more than 20 parts by weight with respect to 100 parts by weight of the monomer mixture.

The styrene block copolymer as a dispersant for carbon black is included in an amount of 0.05 to 5 parts by weight, preferably 0.1 to 4 parts by weight, and more preferably 0.2 to 3 parts by weight with respect to 100 parts by weight of the monomer mixture. In light of the dispersability of carbon black, the styrene block copolymer is included in an amount of at least 0.05 parts by weight. In case of being included in an amount of more than 5 parts by weight, it can cause a decrease in transcription efficiency.

Copper phthalocyanine as a dispersant for carbon black is included in an amount of 0.1 to 3 parts by weight, preferably 0.2 to 2.5 parts by weight, and more preferably 0.3 to 2 parts by weight with respect to 100 parts by weight of the monomer mixture. In light of improving the dispersability of carbon black, copper phthalocyanine is included in an amount of at least 0.1 parts by weight. In case of being included in an amount of more than 3 parts by weight, it can cause a decrease in transcription efficiency and a degenerated color as well.

In the preparation process of a polymerized toner of the present invention, the monomer mixture comprises a wax and a charge control agent together with the binder resin monomers, carbon black, the styrene block copolymer, and copper phthalocyanine.

For the wax, one can use at least one selected from the group consisting of petroleum waxes such as paraffin wax, microcrystalline wax, or ceresin wax; natural waxes such as carnauba wax; synthetic waxes such as polyester wax, polyethylene wax or polypropylene wax; and a mixture thereof.

The wax can be included in an amount of 0.1 to 30 parts by weight, preferably 1 to 25 parts by weight, more preferably 5 to 20 parts by weight with respect to 100 parts by weight of the monomer mixture. The wax should be included in an amount of at least 0.1 parts by weight in order to prevent the offset phenomenon wherein toners contaminate the fusing roller in the fusing process. If the wax is included in an amount of more than 30 parts by weight, it can cause deterioration in chargeability of the toner particles, making it difficult to achieve a uniform image and proper transcription efficiency.

The charge control agent can comprise at least one of a cationic charge control agent, an anionic charge control agent, and a mixture thereof. The cationic charge control agent comprises a nigrosine dye, higher aliphatic metal salts, alkoxyamines, chelates, quaternary ammonium salts, alkylamides, fluorinated activators, metal salts of naphthalenic acid, and a mixture thereof; the anionic charge control agent comprises a chlorinated paraffin, a chlorinated polyester, an acid-containing polyester, sulfonylamine of copper phthalocyanine, sulfonic acid group, and a mixture thereof.

Further, what is preferable for the charge control agent is a copolymer with a sulfonic acid group, and more preferably, one can use a copolymer with a sulfonic acid group having a weight average molecular weight of 2,000 to 200,000, still more preferably a copolymer with a sulfonic acid group having an acid value of 1 to 40 mg KOH/g and a glass transition temperature of 30 to 120° C. If the acid value is less than 1, the copolymer cannot serve as a charge control agent. If the acid value exceeds 40, it may have an undesirable effect on the inter-surface properties of the monomer mixture, worsening the polymerization stability. In addition, if the glass transition temperature is below 30° C., the low glass transition temperature of the charge control agent as exposed to the surface may cause a friction-melting between toner particles on printing, resulting in a blocking phenomenon. If the glass transition temperature is high than 120° C., it make the toner surface excessively hard, which is undesirable for coating and fusing properties. Moreover, if the weight-average molecular weight is less than 2,000, the copolymer has a lower surface concentration due to its higher compatibility with the binder resin, thereby failing to play a role of a charge control agent. On the contrary, such a high weight-average molecular weight exceeding 200,000 would bring about an increased viscosity of the monomer mixture, which has an undesirable effect on the polymerization stability and the distribution of the particle size. As specific examples of the copolymer with a sulfonic acid group, mentions may be made of a styrene-acrylic copolymer having a sulfonic acid group, a styrene-methacrylic copolymer having a sulfonic acid group, or a mixture thereof, but the present invention is not limited thereto.

The charge control agent can be included in an amount of 0.1 to 5 parts by weight, preferably 0.3 to 4 parts by weight, more preferably 0.5 to 3 parts by weight with respect to 100 parts by weight of the monomer mixture. In order to impart a sufficient level of chargeability to the toner particles, the charge control agent should be present in an amount of at least 0.1 parts by weight. In case of being included in an amount of more than 5 parts by weight, the toner particle as formed in the suspension polymerization would have a broad particle size distribution, which can bring about problems of lowered transcription efficiency and an non-uniform image.

In addition, the monomer mixture may further comprise at least one additive selected from the group consisting of an initiator, a crosslinker, a lubricant (e.g., oleic acid, stearic acid, and the like), a molecular weight controlling agent, and a coupling agent.

For the initiator, one can use an oil-soluble initiator and a water-soluble initiator. Specifically, it is possible to use an azo-based initiator such as azobis(isobutyronitrile), azobis (valeronitrile), and the like; an organic peroxide such as benzoyl peroxide, lauroyl peroxide, and the like; the water-soluble initiator typically used in the art such as potassium persulfate, ammonium persulfate, and the like, among which at least one or at least two compounds can be used alone or in a mixture. The used amount of the initiator can be no more than 10 parts by weight, or 0.1 to 10 parts by weight, preferably no more than 8 parts by weight, or 0.3 to 8 parts by weight, more preferably no more than 5 parts by weight, or 0.5 to 5 parts by weight with respect to 100 parts by weight of the monomer mixture.

For the crosslinker, one can use at least one selected from the group consisting of divinylbenzene, ethylene dimethacrylate, ethylene glycol dimethacrylate, diethylene gylcol diacrylate, 1,6-hexamethylene diacrylate, allyl methacrylate, 1,1,1-trimethylolpropane triacrylate, triallylamine and tetra allyl oxyethane, in an amount of 5 parts by weight or less, or 0.01 to 5 parts by weight, preferably 4 parts by weight or less, or 0.05 to 4 parts by weight, more preferably 3 parts by weight or less, or 0.1 to 3 parts by weight with respect to 100 parts by weight of the monomer mixture.

For the molecular weight controlling agent, one can use at least one selected from the group consisting of t-dodecyl mercaptan, n-dodecyl mercaptan, n-octyl mercaptan, carbon tetrachloride and carbon tetrabromide, in an amount of 10 parts by weight or less, or 0.1 to 10 parts by weight, preferably 8 parts by weight or less, or 0.3 to 8 parts by weight, more preferably 5 parts by weight or less, or 0.5 to 5 parts by weight with respect to 100 parts by weight of the monomer mixture.

As the lubricant and the coupling agent, any additives known to be available for a monomer mixture for preparing a polymerized toner may be used in a suitable amount. For example, the lubricant can be used in an amount of 5 parts by weight or less, or 0.01 to 5 parts by weight, preferably 4 parts by weight or less, or 0.05 to 4 parts by weight, more preferably 3 parts by weight or less, or 0.1 to 3 parts by weight with respect to 100 parts by weight of the monomer mixture. The coupling agent can be used in an amount of 5 parts by weight or less, or 0.01 to 5 parts by weight, preferably 4 parts by weight or less, or 0.05 to 4 parts by weight, more preferably 3 parts by weight or less, or 0.1 to 3 parts by weight with respect to 100 parts by weight of the monomer mixture.

In the present invention, the monomer mixture having the foregoing composition can be prepared by comprising the binder resin monomers, carbon black, the styrene block copolymer, copper phthalocyanine, the charge control agent, and the wax and optionally by adding some additives thereto.

The monomer mixture as described above can be mixed into the aqueous dispersion and subjected to a suspension polymerization to form toner particles. More specifically, the formation of the toner particles can comprise the steps of adding the monomer mixture to the aqueous dispersion; homogenizing the monomer mixture in the aqueous dispersion in the form of droplets by applying shearing force to the aqueous dispersion and the monomer mixture; and subjecting the homogenized monomer mixture to a suspension polymerization. As described above, the monomer mixture and the aqueous dispersion can be homogenized by using a homogenizer.

Uniformly dispersing the monomer mixture in the aqueous dispersion to have a form of fine droplets and subjecting the same to a polymerization reaction make it possible to obtain properly-sized, spherical toner particles. For dispersing the monomer mixture in the form of fine water drops (droplets), one can use a homogenizer to apply a shearing force to the monomer mixture and the aqueous dispersion and thereby homogenize the same. Specifically, by using the homogenizer, the monomer mixture as mixed with the aqueous dispersion solution may be homogenized at a speed of 5,000 rpm to 20,000 rpm, preferably 8,000 rpm to 17,000 rpm, and thereby the monomer mixture can be dispersed in the aqueous dispersion to have the form of fine droplets.

The suspension polymerization may be carried out at a temperature of 60 to 90° C. for 8 to 20 hours. In a preferred embodiment, the suspension polymerization can be conducted at a temperature of 50 to 70° C. for 8 to 12 hours, and then at an elevated temperature of 80 to 100° C. for 0.5 to 4 hours. By conducting such a suspension polymerization, the stability of carbon black in the toner particles as prepared can increase due to the uniform distribution of the carbon black particles. As a result, one can realize a printing product with an enhanced image concentration and higher transcription efficiency.

After the formation of the toner particles through the suspension polymerization as described above, the preparation process of the present invention can further comprise the steps of washing the toner particles to remove the dispersant therefrom and drying the toner particles, so as to produce a polymerized toner in accordance with another embodiment of the present invention.

The step of removing the dispersant can comprise adjusting the pH to be suitable for dissolving the dispersant. By adding a water-soluble, inorganic acid to the dispersion comprising the toner particles as prepared to adjust its pH to 2 or less, preferably 1.5 or less, the dispersant can be dissolved into the aqueous solution phase and removed from the toner particles. In removing the dispersant, the dispersion with a properly adjusted pH is stirred for at least 5 hours in order for the dispersant to be dissolved well, and then by using a filtering device, it is possible to produce a toner slurry containing water in an amount less than 50% by weight. In the step of removing the dispersant, a step of homogenizing the solution by applying shearing force thereto with a homogenizer and a separation step with using a centrifugal device can be applied as well. After the steps of dispersing the dispersant, one can repeat a few times of the steps of removing moisture with a filtering device and adding an excess amount of distilled water so as to remove the dispersant more effectively.

The step of drying the toner particles comprises the step of vacuum-drying a toner cake, from which the dispersant already removed, in a vacuum oven at room temperature. However, the present invention is not limited thereto and any drying method known to be typically used for the preparation process of a polymerized toner can be employed with no limitation.

Further, in an embodiment of the present invention, the process can comprise coating an external additive on the outside of the toner particles. In such a coating process, an additional external additive such as an inorganic powder including silica, titanium dioxide, or a mixture thereof can be coated onto the surface of the toner particle. Coating the external additive can be carried out by a high-speed stirring after the addition of the external additive to the toner particles with using Henschel mixer. For the silica, it is possible to use any one known to be usable for a polymerized toner without particular limitation, and what can be preferably used is the one surface-treated with a silane compound such as dimethyl dichloro silane, dimethyl polysiloxane, hexamethyldisilazane, amino silane, alkyl silane, or octamethyl cyclotetrasiloxane. For the titanium dioxide, one can use a rutile-structured one, which is stable at a high temperature, or an anataze-structured one, which is stable at a low temperature, alone or in a mixture thereof. The applicable titanium dioxide has a particle size of 80 to 200 nm, preferably 100 to 150 nm.

According to other embodiment of the present invention is provided a polymerized toner as prepared from the foregoing methods, wherein carbon black, the styrene block copolymer, copper phthalocyanine, the charge control agent, and the wax can be dispersed in the binder resin.

To complete the present invention, what has been experimentally found by the present inventors is that a polymerized toner comprising a dispersant for carbon black consisting of a styrene block copolymer and copper phthalocyanine as dispersed in the binder resin of the toner particles can provide a printing product with a higher image concentration and increased transcription efficiency. Such a polymerized toner can be applied in the field of printing a picture that requires a higher image concentration.

The binder resin can comprise polymers of at least one monomer selected from the group consisting of a styrene monomer, an acrylate monomer, a methacrylate monomer, a diene monomer, an acidic olefin monomer, and a basic olefin monomer. More preferably, the binder resin can comprise a copolymer of (a) a styrene monomer and (b) at least one monomer selected from the group consisting of an acrylate monomer, a methacrylate monomer, and a diene monomer. The binder resin monomer can be the same as described above so that specific explanations will be omitted.

The binder resin can comprise a polymer or a copolymer having a weight average molecular weight of 100,000 to 200,000, preferably 120,000 to 180,000.

The polymerized toner can comprise 50 to 95 part by weight, preferably 60 to 93 parts by weight, more preferably 70 to 90 parts by weight of the binder resin; 1 to 20 parts by weight, preferably 2 to 15 parts by weight, more preferably 3 to 10 parts by weight of carbon black; 0.05 to 5 parts by weight, preferably 0.1 to 4 parts by weight, more preferably 0.2 to 3 parts by weight of the styrene block copolymer; 0.1 to 3 parts by weight, preferably 0.2 to 2.5 parts by weight, more preferably 0.3 to 2 parts by weight of copper phthalocyanine; 0.1 to 5 parts by weight, preferably 0.3 to 4 parts by weight, more preferably 0.5 to 3 parts by weight of the charge control agent; and 0.1 to 30 parts by weight, preferably 1 to 25 parts by weight, more preferably 5 to 20 parts by weight of the wax, with respect to 100 parts of the total weight of the toner. In this regard, carbon black, the styrene block copolymer, copper phthalocyanine, the charge control agent, and the wax are the same as set for the in the above so that specific explanations will be omitted.

If necessary, the polymerized toner can further comprise at least one additive selected from the group consisting of 10 parts by weight or less or 0.1 to 10 parts by weight, preferably 8 parts by weight or less or 0.3 to 8 parts by weight, more preferably 5 parts by weight or less or 0.5 to 5 parts by weight of the initiator; 5 parts by weight or less or 0.01 to 5 parts by weight, preferably 4 parts by weight or less or 0.05 to 4 parts by weight, more preferably 3 parts by weight or less or 0.1 to 3 parts by weight of the crosslinker; 10 parts by weight or less or 0.1 to 10 parts by weight, preferably 8 parts by weight or less or 0.3 to 8 parts by weight, more preferably 5 parts by weight or less or 0.5 to 5 parts by weight of the molecular weight controlling agent; a proper amount of the lubricant (e.g., oleic acid, stearic acid, or the like), for example, 5 parts by weight or less or 0.01 to 5 parts by weight, preferably 4 parts by weight or less or 0.05 to 4 parts by weight, more preferably 3 parts by weight or less or 0.1 to 3 parts by weight of the lubricant; and a proper amount of the coupling agent, for example, 5 parts by weight or less or 0.01 to 5 parts by weight, preferably 4 parts by weight or less or 0.05 to 4 parts by weight, more preferably 3 parts by weight or less or 0.1 to 3 parts by weight of coupling agent, with respect to 100 parts of total weight of the toner.

In addition, as described above, the obtained toner particles can be made a toner core to be coated with silica or the like on their surfaces.

The polymerized toner as prepared in accordance with the present invention can have not only a narrow particle size distribution but also excellent properties enabling the realization of uniform images with a higher image concentration and superior transcription efficiency. In particular, the volume average diameter of the polymerized toner particles can be 4 to 10 μm, preferably 5 to 9 μm, and more preferably 7.0 to 8.5 μm, with a standard deviation corresponding to the ratio between the volume average particle diameter and the number average particle diameter being no more than 1.3. The average diameter of the polymerized toner particle can be at least 4 μm in light of the image concentration and the prevention of the scattering while it can be no more than 10 μm in light of the reduction in toner consumption. In addition, the transcription efficiency of the polymerized toners is at least 94% and the image concentration on printing paper is at least 1.5, indicating that the toner has highly enhanced properties.

With the application of the preparation process of a polymerized toner in accordance with the embodiments of the present invention as described above, when a certain styrene block copolymer and copper phthalocyanine are used within a predetermined range of the amounts for a dispersant for carbon black to carry out a suspension polymerization, toners with a narrow particle size distribution and superior chargeability due to enhanced stability of carbon black in the toner particles can be produced effectively. In particular, the polymerized toner prepared according to the present invention can show an improved an image concentration and realize the high transcription efficiency, thereby achieving best performance in the field of developing electronic pictures.

EXAMPLE

Hereinafter, the actions and the effects of the present invention will be described in detail through specific examples of the invention. However, these examples are merely illustrative of the present invention and the scope of the invention should not be construed to be defined thereby.

Example 1

Preparation of a Polymerized Toner 686 g of 0.1M an aqueous solution of sodium phosphate were mixed with 100 g of 1M calcium chloride in 500 g of water and stirred at 70° C. for 20 minutes to prepare an aqueous dispersion comprising calcium phosphate crystals as precipitated therefrom. In the aqueous dispersion, the content of calcium phosphate was made to be 3 parts by weight with respect to 100 parts by weight of the following monomer mixture.

144 g of styrene and 36 g of n-butyl acrylate for binder resin monomers, 4 g of allyl methacrylate for a crosslinker, 0.4 g of n-dodecyl mercaptane for a molecular weight controlling agent, and 5 g of a styrene-acrylate polymer charge control agent comprising a sulfonic acid group with a weight average molecular weight of 16,500 (FCA 1001 NS, Hujikura Kasei) were mixed and dissolved well, and then 10 g of carbon black (MA 100, cabot), 5 g of a styrene-butadiene-styrene (SBS) block copolymer, and 2 g of copper phthalocyanine were added thereto and stirred in a bead mill at 2000 rpm for 2 hours and then the beads were taken away therefrom. The contents of carbon black, the styrene-butadiene-styrene block copolymer, and copper phthalocyanine were 4.85 parts by weight, 2.42 parts by weight, and 0.97 parts by weight, based on 100 parts by weight of the monomer mixture, respectively.

Then, the mixture, from which the beads had been already taken away, was heated to 70° C. by using a water bath and 20 g of a paraffin wax was added thereto and stirred for 20 minutes, and then 3.6 g of an azo-nitrile initiator (Azo nitrile, V65, Waco co. Ltd.) was added thereto and further stirred for about one and a half minutes to provide a monomer mixture, the weight of which was 230 g.

The monomer mixture was added to the aqueous dispersion and by applying shearing force thereto with a homogenizer at a speed of 13,000 rpm, the monomer mixture was dispersed and homogenized in the aqueous dispersion in the form of fine drops. The monomer mixture as dispersed in the aqueous dispersion in the form of fine droplets through the homogenization was subjected to a reaction at 70° C. for 15 hours while being stirred with a paddle-type stirrer at 200 rpm to produce a polymerized toner.

Washing and Drying of the Toner Particles

By adding HCl to the slurry comprising the polymerized toner, its pH was adjusted to be less than 2, and calcium phosphate was dissolved therein. Through a filtering process, water was removed from the slurry so that the water content of the slurry decreased to 30% by weight or less. Again, distilled water was added thereto in an amount of two times the initial weight of the slurry to dilute the same and then through the filtering process, the remaining water was removed from the slurry so that its water content decreased to 30% by weight or less. By repeating such dilution and filtration process another 10 times, calcium phosphate and other impurities were removed from the toner surfaces.

After water was finally removed through the filtration, the toner cake was put into a vacuum oven to be vacuum-dried at room temperature for 48 hours to provide polymerized toner cores. For the polymerized toner cores as prepared, a measurement by the SEM revealed that the volumetric average particle diameter and the ratio between the volumetric average particle diameter and the number average particle diameter (i.e., the standard deviation) was 7 μm and 1.26 μm, respectively.

Coating with an External Additive

By using Henschel mixer, 2 parts by weight of silica was added to 100 parts by weight of the polymerized toner cores and coated on the surface of the polymerized toner cores at a speed of 5,000 rpm for 7 minutes under a high-speed stirring.

Examples 2 to 9

The polymerized toners were prepared with the same method as set forth in Example 1, except for using a styrene-ethylene-butadiene-styrene (SEBS) block copolymer as a block copolymer component for a polymer dispersant, changing the content of the block copolymer, or changing the content of the metallic compound dispersant, i.e., copper phthalocyanine, according to the following Table 1.

Comparative Examples 1 to 10

The polymerized toners were prepared with the same method as set forth in Example 1, except for changing the carbon black content, the components and their contents of the block copolymer as a polymer dispersant, and the components and their contents of the metallic compound dispersant according to the following Table 1.

Experimental Example

For the polymerized toners as prepared in Examples 1 to 9 and Comparative Examples 1 to 10, the property evaluations were conducted as follows.

Measurement of Image Concentration

After the front side of a sheet of A4-sized paper was printed with a laser printer (HP2600, made by Hewlett Packard), the image concentrations were measured at each edge and the center part by using a densitometer (RD918, Macbath) and the results were averaged out.

Transcription Efficiency

After a feeding section of the cartridge of a laser printer (HP4600, made by Hewlett Packard) was filled with the above polymerized toners, the total weight of the feeding section was weighed. Rectangle shapes (width: 19 cm, height: 1.5 cm) were printed on 1,000 sheets of A4-sized paper and then the weight of the feeding section was weighed again and the consumed amount of the toner was calculated by the following Equation 1:

The Consumed amount (g)=the weight of the feeding section before a 1000-sheet printing−the weight of the feeding section after a 1000-sheet printing [Equation 1]

In addition, the drum section detachable with the feeding section was weighed before and after the printing to calculate the amount of the toner that was wasted without being transcribed onto paper by using the following Equation 2:

The wasted amount of the toner (g)=the weight of the drum section after a 1000 sheet printing−the weight of the drum section before a 1000 sheet printing [Equation 2]

After the calculation of the consumed and the wasted amounts of the toner as above, the transcription efficiency was calculated by using the following Equation 3:

Transcription efficiency(%)={(the consumed amount−the wasted amount)/the consumed amount}*100. [Equation 3]

The evaluation results of the image concentration and the transcription efficiency for the polymerized toners as prepared from Examples 1 to 9 and Comparative Examples 1 to 10 are shown in Table 1, wherein the unit for the content of each component is parts by weight.

TABLE 1

| | Carbon black | | | | | | Polymerized toner | | | |
|---|---|---|---|---|---|---|---|---|---|---|
| | | | Polymer dispersant | | Metallic compound dispersant | | | | | |
| classification | Average particle diameter (nm, nanometer) | content | component | content | component | content | Average particle diameter (μm, micrometer) | Standard deviation | Image concentration | Transcription efficiency (%) |
| Example 1 | 30 | 4.85 | SBS | 2.42 | Cu-phthalocyanine | 0.97 | 7.2 | 1.25 | 1.5 or higher | 95 |
| Example 2 | 30 | 4.86 | SBS | 2.43 | Cu-phthalocyanine | 0.49 | 7.0 | 1.25 | 1.5 or higher | 94 |
| Example 3 | 30 | 4.85 | SEBS | 2.42 | Cu-phthalocyanine | 0.97 | 7.3 | 1.26 | 1.5 or higher | 95 |
| Example 4 | 30 | 4.86 | SEBS | 2.43 | Cu-phthalocyanine | 0.49 | 7.1 | 1.25 | 1.5 or higher | 94 |
| Example 5 | 30 | 4.86 | SBS | 0.05 | Cu-phthalocyanine | 0.97 | 6.8 | 1.25 | 1.5 or higher | 95 |
| Example 6 | 30 | 4.86 | SBS | 1.00 | Cu-phthalocyanine | 0.97 | 6.9 | 1.26 | 1.5 or higher | 94 |
| Example 7 | 30 | 4.86 | SEBS | 3.00 | Cu-phthalocyanine | 0.97 | 7.3 | 1.26 | 1.5 or higher | 95 |
| Example 8 | 30 | 4.86 | SEBS | 5.00 | Cu-phthalocyanine | 0.97 | 7.5 | 1.26 | 1.5 or higher | 94 |
| Example 9 | 30 | 4.86 | SEBS | 2.42 | Cu-phthalocyanine | 2 | 7.4 | 1.25 | 1.5 or higher | 95 |
| Comp. Example 1 | 30 | 0.5 | SBS | 2.42 | Cu-phthalocyanine | 0.97 | 6.5 | 1.25 | 0.6 | 92 |
| Comp. Example 2 | 30 | 21 | SBS | 2.42 | Cu-phthalocyanine | 0.97 | 10.5 | 1.4 | 1.5 | 92 |
| Comp. Example 3 | 30 | 5.02 | — | — | — | — | 6.5 | 1.26 | 1.4 | 80 |

TABLE 1-continued

| | Carbon black | | | | | | Polymerized toner | | | |
|---|---|---|---|---|---|---|---|---|---|---|
| | Average particle diameter (nm, | | Polymer dispersant | | Metallic compound dispersant | | Average particle diameter (μm, | Standard | Image | Transcription efficiency |
| classification | nanometer) | content | component | content | component | content | micrometer) | deviation | concentration | (%) |
| Comp. Example 4 | 30 | 4.89 | SBS | 2.45 | — | — | 7.0 | 1.25 | 1.4 | 85 |
| Comp. Example 5 | 30 | 4.97 | — | — | Cu-phthalocyanine | 0.99 | 7.1 | 1.26 | 1.5 | 80 |
| Comp. Example 6 | 30 | 4.85 | SBS | 2.42 | Cu-phthalocyanine | 0.05 | 7.2 | 1.26 | 1.4 | 89 |
| Comp. Example 7 | 30 | 4.85 | SBS | 2.42 | Cu-phthalocyanine | 4 | 7.1 | 1.26 | 1.5 | 80 |
| Comp. Example 8 | 30 | 4.85 | SBS | 5.5 | Cu-phthalocyanine | 0.97 | 7.6 | 1.28 | 1.4 | 85 |
| Comp. Example 9 | 30 | 4.85 | PET | 2.42 | Cu-phthalocyanine | 0.97 | 7.2 | 1.26 | 1.4 | 90 |
| Comp. Example 10 | 30 | 4.85 | SBS | 2.42 | Zn-phthalocyanine | 0.97 | 7.3 | 1.26 | 1.4 | 85 |

As shown in Table 1, it has been found that the polymerized toners of Examples 1 to 9 according to the present invention using the styrene block copolymer and copper phthalocyanine as a pigment dispersant show significantly enhanced transcription efficiency and have an excellent particle size distribution and a high image concentration. In particular, using the polymerized toners makes it possible to realize high transcription efficiency of at least 94% or 95% and their image concentrations are at least 1.5, showing that a remarkably enhanced results can be obtained.

In contrast, the experimental results for Comparative Example 1 show that when the carbon black content was only 0.5 parts by weight, the image concentration was significantly lowered to 0.6 and the volumetric average diameter of the toner particles became smaller to 6.5 p.m. On the other hand, the experimental results for Comparative Example 2 show that when the toner included an excessive amount of carbon black in the order of 21 parts by weight, not only did the transcription efficiency deteriorate but also the volumetric average diameter of the toner particles increased to 10.5 μm so that the standard deviation corresponding to the ratio between the volumetric average diameter of the particles and the number average diameter of the particles reached 1.4. As a result, such toner particles had a very broad particle size distribution and an irregular shape, possibly leading to the problems of poor chargeability or flowability and the increased consumption of the toners. Moreover, when no dispersant for carbon black was used at all (see, Comparative Example 3), or when the styrene block copolymer was used alone without using copper phthalocyanine (see, Comparative Example 4), or when copper phthalocyanine was used alone without using the styrene block copolymer (see, Comparative Example 5), the transcription efficiency was significantly lowered to 80% or 85%. Further, in case of not comprising copper phthalocyanine (see, Comparative Examples 3 and 4), the toner also showed a poor image concentration in the order of 1.4.

Meanwhile, the results for Comparative Examples 6 and 7 show that despite using the styrene block copolymer and copper phthalocyanine together for the carbon black dispersant, when the content of copper phthalocyanine was only 0.05 parts by weight, the image concentration was lowered to about 1.4 and the transcription efficiency was also poor in the order of 89%. On the other hand, when an excess amount of copper phthalocyanine such as 4 parts by weight was used, the transcription efficiency was significantly lowered to 80%. Also, the results for Comparative Example 8 show that despite using the styrene block copolymer and copper phthalocyanine together, when the content of the styrene block copolymer fell outside the range of 0.05 to 5 parts by weight, the image concentration was significantly lowered to about 1.4 and the transcription efficiency was also poor in the order of 85% and 90%.

In addition, when a polyethylene terephthalate (PET) polymer was used as a polymer dispersant instead of the styrene block copolymer (see, Comparative Example 9) and when zinc phthalocyanine was used as a metallic compound dispersant instead of copper phthalocyanine (see, Comparative Example 10), the image concentration was significantly lowered to about 1.4 and the transcription efficiency was significantly lowered to 90% and 85%, respectively.

Hereinabove, the preferred embodiments of the present invention have been explained in detail, but the scope of the present invention should not be limited thereto, and various modifications and improvements made by a person of ordinary skill in the art with using a basic concept defined by the following claims should also be construed to belong to the scope of the present invention.

What is claimed is:

1. A process for preparing a polymerized toner, which comprises the steps of:

forming an aqueous dispersion comprising a dispersant;

forming a monomer mixture comprising a binder resin monomer, carbon black, a styrene block copolymer, copper phthalocyanine, a charge control agent, and a wax; and adding the monomer mixture to the aqueous dispersion and subjecting the same to a suspension polymerization to form toner particles, wherein the styrene block copolymer and copper phthalyocyanine are used together as a dispersant for carbon black, and wherein 1 to 20 parts by weight of carbon black, 0.05 to 5 parts by weight of the styrene block copolymer, and 0.1 to 3 parts by weight of copper phthalocyanine are included with respect to 100 parts by weight of the monomer mixture.

2. The process for preparing a polymerized toner according to claim 1, wherein the weight average molecular weight of the styrene block copolymer is 2,000 to 200,000.

3. The process for preparing a polymerized toner according to claim 1, wherein the wax and the charge control agent are include in an amount of 0.1 to 30 parts by weight and in an amount of 0.1 to 5 parts by weight, respectively, based on 100 parts by weight of the monomer mixture.

4. The process for preparing a polymerized toner according to claim 1, wherein the dispersant comprises at least one selected from the group consisting of an inorganic dispersant, a water soluble organic dispersant, and an anionic surfactant.

5. The process for preparing a polymerized toner according to claim 1, wherein the binder resin monomer is at least one selected from the group consisting of an aromatic vinyl monomer, an acrylate monomer, a methacrylate monomer, and a diene monomer.

6. The process for preparing a polymerized toner according to claim 1, wherein the wax is selected from the group consisting of paraffin wax, microcrystalline wax, ceresin wax, carnauba wax, polyester wax, and polypropylene wax.

7. The process for preparing a polymerized toner according to claim 1, wherein the charge control agent is at least one selected from the group consisting of a cationic charge control agent, an anionic charge control agent, and a mixture thereof.

8. The process for preparing a polymerized toner according to claim 1, wherein the monomer mixture further comprises at least one additive selected from the group consisting of an initiator, a crosslinker, a lubricant, a molecular weight controlling agent, and a coupling agent.

9. The process for preparing a polymerized toner according to claim 1, wherein the average diameter of carbon black particles is 20 to 50 nm.

10. The process for preparing a polymerized toner according to claim 1, wherein the formation of the toner particles comprises the steps of adding the monomer mixture to the aqueous dispersion;

homogenizing the monomer mixture in the aqueous dispersion in the form of droplets by applying shearing force to the aqueous dispersion and the monomer mixture; and subjecting the homogenized monomer mixture to a suspension polymerization.

11. The process for preparing a polymerized toner according to claim 1, wherein the suspension polymerization comprises the step of conducting a reaction at a temperature of 50 to 70° C. for 8 to 12 hours and then conducting a reaction at an elevated temperature of 80 to 100° C. for 0.5 to 4 hours.

12. The process for preparing a polymerized toner according to claim 1, wherein it further comprises the steps of removing the dispersant; and drying the toner particles.

13. The process for preparing a polymerized toner according to claim 1, wherein it further comprises a step of coating an external additive on the outside of the toner particles.

14. The process for preparing a polymerized toner according to claim 1, wherein 2 to 15 parts by weight of carbon black, 0.1 to 4 parts by weight of the styrene block copolymer, and 0.2 to 2.5 parts by weight of copper phthalyocyanine are included with respect to 100 parts by weight of the monomer mixture.

15. The process for preparing a polymerized toner according to claim 7, wherein the cationic charge control agent is at least one selected from the group consisting of a nigrosine dye, higher aliphatic metal salts, alkoxyamines, chelates, quaternary ammonium salts, alkylamides, fluorinated activators, and metal salts of naphthalenic acid; and the anionic charge control agent is at least one selected from the group consisting of a chlorinated paraffin, a chlorinated polyester, an acid-containing polyester, a sulfonylamine of copper phthalocyanine, and a sulfonic acid group.

* * * * *